US007278841B2

(12) United States Patent
Phillips

(10) Patent No.: US 7,278,841 B2
(45) Date of Patent: Oct. 9, 2007

(54) GEROTOR PUMP

(75) Inventor: Edward H. Phillips, Troy, MI (US)

(73) Assignee: Performance Pumps, LLC, Southfield, MI (US)

( * ) Notice: Subject to any disclaimer, the term of this patent is extended or adjusted under 35 U.S.C. 154(b) by 122 days.

(21) Appl. No.: 10/767,828

(22) Filed: Jan. 29, 2004

(65) Prior Publication Data

US 2004/0184942 A1 Sep. 23, 2004

Related U.S. Application Data

(63) Continuation-in-part of application No. PCT/US02/39812, filed on Dec. 11, 2002.

(60) Provisional application No. 60/349,770, filed on Jan. 18, 2002, provisional application No. 60/341,510, filed on Dec. 13, 2001.

(51) Int. Cl.

| | |
|---|---|
| ***F03C 2/00*** | (2006.01) |
| ***F04C 2/00*** | (2006.01) |
| ***F04C 15/00*** | (2006.01) |

(52) U.S. Cl. ..... 418/132; 418/166; 418/168; 418/171

(58) Field of Classification Search ..... 418/171, 418/166, 168, 132, 133
See application file for complete search history.

(56) References Cited

U.S. PATENT DOCUMENTS

| | | | | |
|---|---|---|---|---|
| 3,034,447 | A | | 5/1962 | Brundage |
| 3,034,448 | A | * | 5/1962 | Brundage ..... 418/171 |
| 3,824,047 | A | | 7/1974 | McDermott |
| 3,907,465 | A | | 9/1975 | Dorff et al. |
| 4,013,388 | A | * | 3/1977 | Stratman ..... 418/171 |
| 5,711,408 | A | * | 1/1998 | Dick ..... 418/171 |

FOREIGN PATENT DOCUMENTS

GB 76033 A1 * 4/1983

* cited by examiner

*Primary Examiner*—Theresa Trieu
(74) *Attorney, Agent, or Firm*—Gifford, Krass, Sprinkle, Anderson & Citkowski, P.C.

(57) ABSTRACT

Improved gerotor pumps comprising laterally constrained floating rings, thereby providing an orthogonal degree-of-freedom and allowing gerotor sets positioned therein to establish their own preferred mesh orientation, and additionally wherein the outer rotor of the gerotor set is forcibly positioned against the inner rotor of the gerotor set at the gerotor set's in-mesh position whereat there is little relative motion between the inner and outer rotors, thereby resulting in a substantially friction- and wear-free meshing action of the gerotor set.

3 Claims, 5 Drawing Sheets

GEROTOR PUMP

CROSS-REFERENCE TO RELATED APPLICATIONS

The present invention claims priority from U.S. Provisional application Ser. No. 60/443,306 filed Jan. 29, 2003.

BACKGROUND OF THE INVENTION

I. Field of the Invention

The present invention relates generally to gerotor pumps, and more particularly to improved gerotor pumps wherein an outer rotor of gerotor sets utilized therein is enabled for finding its own eccentricity offset axis whereat it is supported mechanically via forcibly meshing with the inner rotor at the gerotor set in-mesh position and otherwise in a nominally hydrostatically balanced manner.

I. Description of the Prior Art

Gerotor pumps are most conveniently designed around commercially available gerotor gear sets (hereinafter simply "gerotor sets") such as those manufactured by Nichols Portland of Portland, ME. Such gerotor sets comprise an inner rotor having N outwardly extending lobes with N approximately circularly shaped grooves therebetween (i.e., with N typically having values of 4, 6, 8 or 10) in mesh with an eccentrically disposed outer rotor comprising N+1 inwardly extending circularly shaped elements. Often the inner rotor is mounted upon and directly driven by the drive shaft of a prime mover such as an electric motor. The eccentrically disposed outer rotor is then driven by the inner rotor via meshing of the outwardly and inwardly extending lobes then instantly located nominally nearest an "in-mesh" position. This meshing contact occurs with near zero relative velocity between inner and outer rotors in the region of the in-mesh position while a maximum relative velocity between tips of the outwardly extending lobes of the inner rotor and the inwardly extending lobes of the outer rotor occurs at the opposite or out-of-mesh position along an eccentricity axis.

Present art gerotor pumps typically comprise a fixedly positioned eccentric gerotor pocket within which the outer rotor is supported by a hydrodynamic bearing formed in the space between the eccentric gerotor pocket and the outer rotor. In most gerotor pumps the gerotor pocket is simply formed as part of the pump housing and then completed by a cover plate wherein inner surfaces of the gerotor pocket and cover plate serve as first and second sides of a gerotor cavity. The bore of the eccentric gerotor cavity is formed about a preferred eccentricity offset rotation axis located along a preferred eccentricity axis at a distance nominally equal to a gear addendum. Axially oriented symmetrical fluid commutation ports are formed in either or both of the first and second sides of the gerotor cavity to either side of the preferred eccentricity axis and are fluidly coupled to housing ports.

In operation, fluid is conveyed from the inlet fluid commutation port to inlet side ones of N+1 pumping chambers formed between the outwardly and inwardly extending lobes and elements as they move out of mesh on the inlet side, and then out the outlet fluid commutation port via outlet side ones of the N+1 pumping chambers as they move back toward mesh on the outlet side. The pumping chambers are formed between N nominal line seals provided by the mesh of the outwardly and inwardly extending lobes and elements and an additional nominal line seal between one inwardly extending element and a juxtaposed one of the grooves of the inner rotor nearest the "in-mesh" position. Thus, fluid entering via the inlet fluid commutation port is conveyed to the outlet fluid commutation port at a pressure value determined by the system load via each of the sequentially moving ones of the N+1 pumping chambers. Interestingly, the shaft must rotate (N+1)/N revolutions for a complete cycle of any of the N+1 pumping chambers.

Transverse or lateral loading between the inner and outer rotors is nominally generated by the product of the difference between the output and input pressures, and the net transverse plan area between instant ones of the sealing lines formed nearest to the "in" and "out" of mesh positions. Normally the outer rotor is directly supported by the hydrodynamic bearing formed between it and the eccentric housing bore as described above. Alternately, a needle bearing could be used to support the outer rotor for a gerotor pump that rotates at too low a speed to generate sufficient hydrodynamic bearing support.

As noted above, prior art gerotor pumps utilize fixedly positioned eccentric gerotor pockets in concert with meshing gerotor sets. As a result of this they are mechanically over constrained whereby it is impractical to utilize closely fitting inner and outer rotors such as are required for generating high output pressure values. And even with the commonly available relatively loose fitting gerotor sets (e.g., with perhaps 0.003 in. dimetral clearance), the actual driving contact position of mesh between inner and outer rotors is indeterminate. Thus, there is considerable variation in frictional rubbing and wear between and of lobes of supposedly identical gerotor pumps.

This concern was addressed in the incorporated '812 patent application wherein gerotor pumps having an additional degree of freedom and thus permitting their outer rotors to find their own optimum centers of rotation under all conditions of loading and shaft deflection were disclosed. Particularly in the case of disclosed gerotor pumps comprising floating rings for locating and supporting the outer rotors, the additional degree of freedom also allowed operation at relatively high output pressure values via utilizing precision formed gerotor sets such as those described in connection with FIGS. 33 through 43 of the incorporated '812 patent application. However, the gerotor pumps disclosed therein continued to utilize gerotor sets wherein lobe-to-lobe contact was possible at positions other than at line seals nearest the in-mesh position (i.e., including the out-of-mesh position). Furthermore, imprecisely defined hydrodynamic bearing supported forces were still present in those gerotor pumps. It would be desirable to provide gerotor pumps comprising floating rings wherein these remaining concerns have been addressed.

The primary object of the present invention, then, is to provide gerotor pumps wherein gerotor sets are forcibly held in mesh at the in-mesh position whereby the outer rotors are mechanically driven by the inner rotors under nominally zero differential velocity meshing conditions and thereby in a substantially friction- and wear-free manner.

SUMMARY OF THE INVENTION

This and other objects are achieved in improved gerotor pumps according to preferred embodiments of the present invention. Similarly to present art gerotor pumps, in the improved gerotor pumps an inner rotor of a gerotor set having N outwardly extending lobes with N approximately circularly shaped grooves therebetween is directly driven from a drive motor's output shaft (hereinafter "the drive shaft"). The inner rotor then drives an outer rotor of the gerotor set having N+1 inwardly extending circularly shaped elements about a preferred eccentricity offset rotation axis located generally along a preferred eccentricity axis.

As implied above, the further improved gerotor pumps disclosed herein are nominally configured with the outer rotor being located within a floating ring that is in turn located laterally with respect to the preferred eccentricity axis by orthogonal guide means formed in a housing gerotor pump cavity. The outer rotor is again supported for rotation by a hydrodynamic bearing formed in the space between the outer rotor and floating ring. As disclosed in the incorporated '812 patent application, the outer rotor and the floating ring are nominally allowed to float along the preferred eccentricity axis. Thus, the position of the outer rotor along the eccentricity axis is generally determined via allowing the mesh of the outer rotor of the gerotor set to determine its own orthogonal location via meshing action between it and the inner rotor. Then forces generated within the hydrodynamic bearing determine the orthogonal location of the floating ring as well.

In the preferred embodiments of the present invention however, the gerotor sets of the further improved gerotor pumps are additionally forcibly urged into mesh along the eccentricity axis at the in-mesh position. This is accomplished via hydrostatically sourced loading of the floating ring in the orthogonal direction. In a preferred embodiment of the present invention delivery pressure is applied to a piston bearing upon the outer surface of the floating ring at a location juxtaposed to the in-mesh position. This results in supplemental orthogonal loading of the outer rotor along the eccentricity axis via naturally occuring rotational adjustments within the hydrodynamic bearing. Thus, an orthogonally directed force proportional to the greater of input and delivery pressures is applied to the in-mesh end of the outer rotor. The end result is that the outwardly and inwardly extending lobes of the inner and outer rotors are held tightly in mesh at the in-mesh position whereat there is almost no relative motion between them and only passive contact elsewhere.

In additional preferred embodiments of the present invention, the outer rotors and floating rings are nominally configured in the manner described in the incorporated '812 patent application with reference to gerotor pump 210 depicted in FIG. 18 therein. In the gerotor pump 210, enhanced porting is obtained via radial face slots formed in either side of the rotor. In addition, these radial face slots convey each individual pumping chamber's pressure to juxtaposed edges of the periphery of the outer rotor. This provides a distribution of pressure around the outer rotor that tends to balance the above mentioned transverse outer rotor loading in the lateral direction.

Also comprised in gerotor pump 210 are face fluid commutation ports formed in either side of the floating ring. The face fluid commutation ports interdict the radial face slots to provide improved commutation. In addition, they convey input and delivery fluid from housing ports and either side of the gerotor pump cavity to and from the appropriate ones of the radial face slots. First and second pins are disposed in first and second slots formed in the outer surface of the floating ring along the eccentricity axis. The pins interface with juxtaposed walls of the pump housing such that they act as check valves in keeping delivery fluid from mixing with inlet fluid. Thus, in gerotor pump 210 the floating ring is somewhat balanced in the lateral direction as well with a residual lateral force being impressed upon the orthogonal guide means.

Of course, the gerotor sets of the improved gerotor pumps disclosed in the additional preferred embodiments of the present invention are also forcibly urged into mesh along the eccentricity axis at the in-mesh position. However, in the additional preferred embodiments of the present invention this is accomplished via differential orthogonal hydrostatic loading of the floating ring in combination with nominally identical orthogonal hydrostatic loading of the outer rotor.

In a unidirectional pump disclosed in a first alternate preferred embodiment of the present invention, the required orthogonal loading of the floating ring is effected by equidistant opposite lateral offsetting of similar first and second slots (e.g., to those used in the gerotor pump 210), and therefore similar first and second pins, on either side of the eccentricity axis. Thus, an orthogonally directed force proportional to the difference between delivery and inlet pressures is again additionally applied to the in-mesh end of the floating ring.

Then first and second holes respectively convey delivery and inlet pressure to first and second cavities respectively formed symmetrically about the eccentricity axis on the inner surface of the floating ring. The first and second cavities are configured such that, in combination with the individual fluid pressures conveyed to the periphery of the outer rotor by the radial face slots, the resulting forces applied to the floating ring along the eccentricity axis are nominally hydrostatically balanced. And of course, the outwardly and inwardly extending lobes of the inner and outer rotors are again held tightly in mesh at the in-mesh position whereat there is almost no relative motion between them and only passive contact elsewhere.

In a reversible pump disclosed in a second alternate preferred embodiment of the present invention, this is similarly accomplished via insertion of first and second pairs of laterally spaced apart pins respectively disposed in first and second pairs of slots formed on the in-mesh and out-of-mesh ends of the floating ring, respectively, with the individual slots of each pair of slots formed equidistant from the eccentricity axis. Slots of the first pair of slots are fluidly coupled one-to-another via linking cavities extruded into the faces of the floating ring. This results in the first pair of pins acting as a pair of check valves that provide the space therebetween with fluid having the higher pressure. On the other hand, the space between the second pair of slots is vented to the lower of inlet and delivery pressures whereby the pin instantly interfacing with the higher pressure fluid acts as a check valve. This results in the second pair of pins acting as a pair of check valves that in this case provide the space therebetween with fluid having the lower pressure. Thus, the first and second sets of pins again orthogonally apply force proportional to the difference between delivery and inlet pressures to the in-mesh end of the floating ring as well as keep delivery fluid from mixing with the inlet fluid. And again, first and second holes and cavities are formed in the floating ring such that the outer rotor is forcibly positioned against the inner rotor at the in-mesh position. And of course, the floating ring is again substantially balanced in the orthogonal direction.

Thus, forces otherwise imposed upon the hydrodynamic bearing have been significantly reduced. And, the outwardly and inwardly extending lobes of the inner and outer rotors are held tightly in mesh at the in-mesh position whereat there is almost no relative motion between them and only passive contact elsewhere. All of this is most important in the case of a reversible pump or hydraulic motor utilized in a servo system wherein very smooth operation at low speeds is required.

Thus, improved methods for supporting a gerotor set positioned in a laterally located floating ring in a gerotor pump have been enabled by the preferred and alternate preferred embodiments of the present invention. These methods minimally comprise the steps of applying force to the floating ring along the eccentricity axis toward the gerotor set's in-mesh position and coupling that force to the space between the floating ring and the outer rotor whereby the outer rotor is forcibly positioned against the inner rotor.

In a first group of aspects, then, the present invention is directed to providing improved gerotor pumps wherein outer rotors laterally constrained by floating rings are forcibly positioned against the inner rotors at the in-mesh position. Included are gerotor pumps wherein the outer rotors are additionally balanced in the lateral direction, and concomitantly, the floating rings are balanced in the orthogonal direction.

In a second group of aspects, the present invention is directed to improved methods for supporting a gerotor set in a gerotor pump, wherein the methods minimally comprise the steps of: applying force to the floating ring along the eccentricity axis toward the gerotor set's in-mesh position and coupling that force to the juxtaposed space between the floating ring and the outer rotor whereby the outer rotor is forcibly positioned against the inner rotor.

BRIEF DESCRIPTION OF THE DRAWING

A better understanding of the present invention will now be had with reference to the accompanying drawing, wherein like reference characters refer to like parts throughout the several views herein, and in which.

DETAILED DESCRIPTION OF THE PREFERRED EMBODIMENTS

Figure 1A:
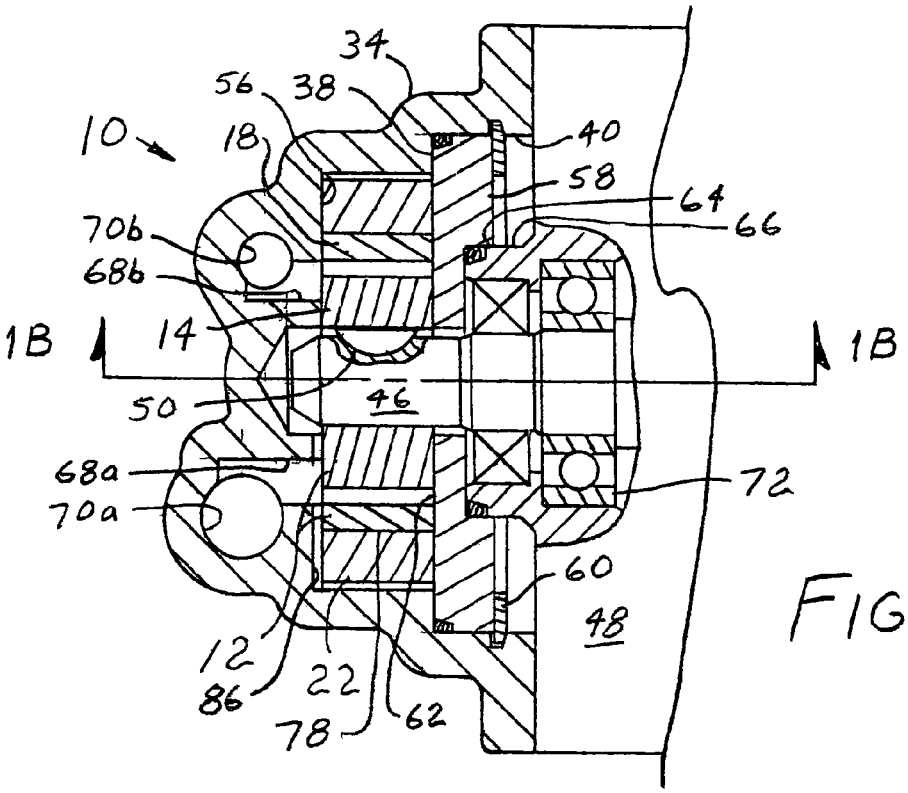
FIGS. 1A and 1B are sectional views of an improved gerotor pump according to a preferred embodiment of the present invention.
Figure 1B:
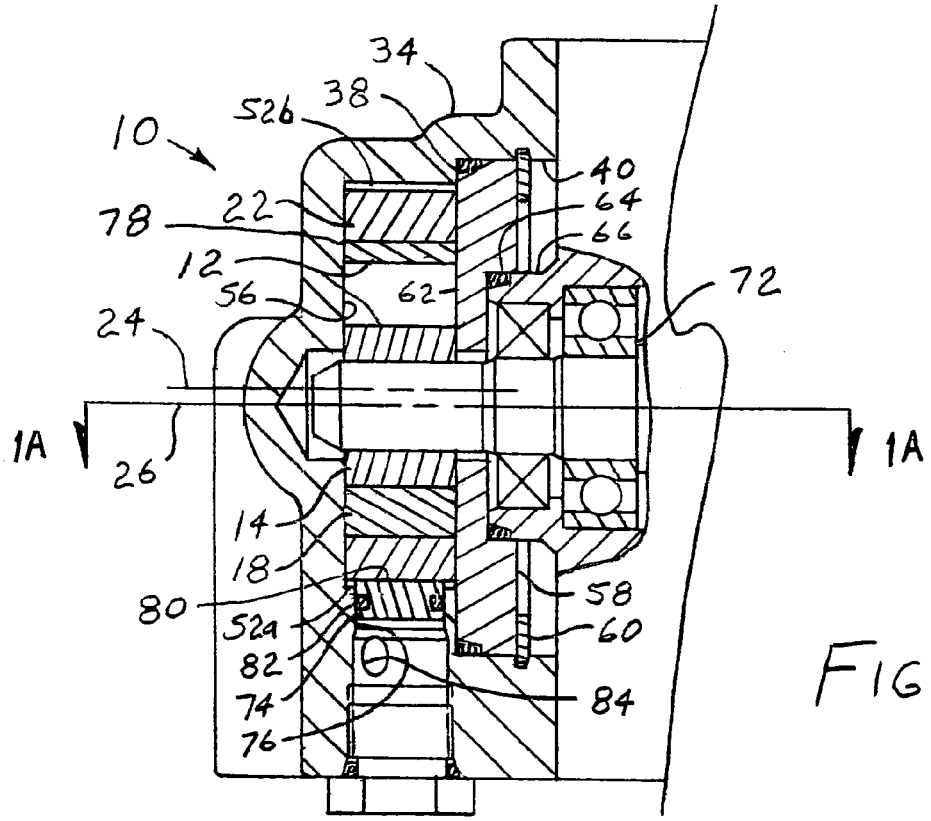
Figure 2:
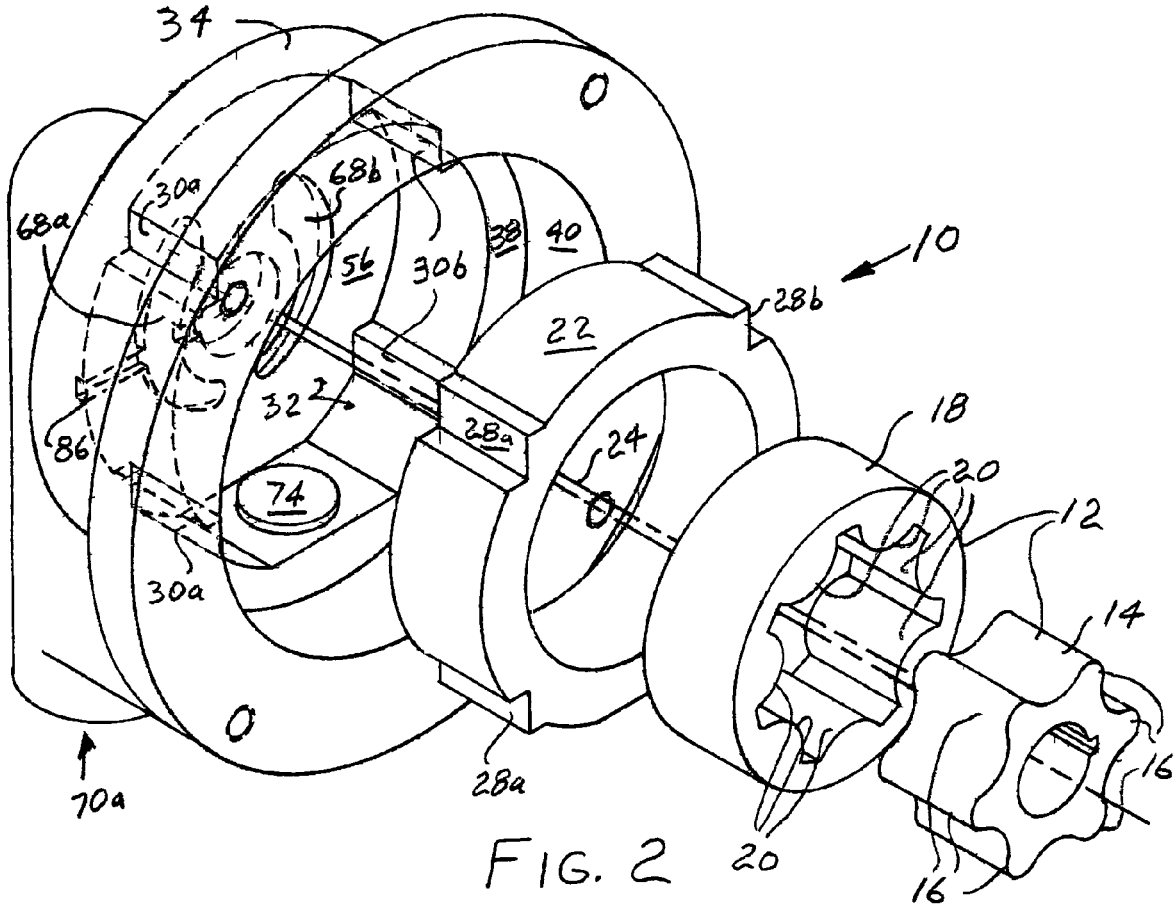
FIG. 2 is an exploded isometric view of operative elements of the improved gerotor pump according to the preferred embodiment of the present invention.

With reference now to FIGS. 1A, 1B, 2, and 3, there-shown in sectional, exploded isometric and plan views is an improved gerotor pump 10 according to a preferred embodiment of the present invention in which a gerotor set 12 comprises an inner rotor 14 having N nominally circularly shaped outwardly extending lobes 16 and an eccentrically disposed outer rotor 18 having N+1 inwardly extending circularly shaped lobes 20. The gerotor set 12 is inserted in a floating ring 22 that is oriented concentrically about a preferred eccentricity offset rotation axis 24 shown in FIGS. 1B, 2 and 3, for instance, as being located along an orthogonal preferred eccentricity axis 54 above an input shaft axis of rotation 26. The actual orthogonal location of the eccentricity offset rotation axis 24 is determined by the mesh of the inner and outer rotors 14 and 18. And in the gerotor pump 10, the actual lateral position of the eccentricity offset rotation axis 24 is determined by the lateral location of the floating ring 22 as positioned by guide flats 28*a* and 28*b* formed on the floating ring 22 slidingly engaging guide shoulders 30*a* and 30*b* formed as part of a gerotor pocket 32. The gerotor pocket 32 is formed in a portion of a housing 34 extending beyond a shoulder 38 that terminates a bore 40 formed therein. The bore 40 is formed in a concentric manner with reference to the preferred position of the input shaft axis of rotation 26.

N+1 pumping chambers 36 are formed between N nominal line seals 42 provided by the mesh of the outwardly and inwardly extending lobes 16 and 20 and an additional nominal line seal 42 between one inwardly extending lobe 20 and a juxtaposed one of N grooves 44 of the inner rotor 14 nearest the "in-mesh" position of the gerotor set 12. The inner rotor 14 is directly driven by the output shaft 46 of a drive motor 48 (hereinafter "the drive shaft 46") via a feature enabling transmission of torque from one element to another such as implemented herein by Woodruff key 50. The outer rotor 18 is rotationally driven in turn by the inner rotor 14 via mesh of the inwardly extending lobes 20 with the groove 44 nearest the "in-mesh" position of the gerotor set 12 and a proximate one of the outwardly extending lobes 16 with via line seals 42 formed therebetween.

Other than the guide shoulders 30*a* and 30*b*, the gerotor pocket 32 is contoured to provide operating clearance for the floating ring 22, and specifically so as to provide freedom of motion in the orthogonal direction for the gerotor set 12 as indicated by numerical indicators 52*a* and 52*b*. Inner surface 56 of the gerotor pocket 32 is formed at a slightly greater depth from the shoulder 38 than the axial thickness of the gerotor set 12 whereby the gerotor set 12 is provided with axial operating clearance after a cover plate 58 is inserted into the bore 40 against the shoulder 38 and is forcibly retained thereat by a beveled retaining ring 60. The inner surface 56 and an inner surface 62 of the cover plate 58 respectively serve as first and second sides of a gerotor cavity for the gerotor set 12. In addition, a bore 64 formed concentrically in the cover plate 58 receives a pilot boss 66 of the drive motor 48 whereby proper alignment of the drive motor 48 is obtained with reference to the preferred position of the input shaft axis of rotation 26.

In gerotor pump 10, axially oriented inlet and delivery fluid commutation ports 68*a* and 68*b* are formed in the inner surface 56 on either side of the preferred eccentricity axis 54 for selectively conveying fluid from inlet port 70*a* to the pumping chambers 36, and from the pumping chambers 36 to delivery port 70*a*. Herein the gerotor pump 10 is assumed to in fact be a pump (e.g., as opposed to a hydraulic motor) with its delivery pressure always exceeding the return pressure. Thus in FIGS. 1A, 1B, 2, and 3, gerotor set 12 is depicted as having a clockwise rotation with axially oriented inlet and delivery fluid commutation ports 68*a* and 68*b* respectively located on the left and right sides. For continuity, this standard of clockwise rotation will be held for all of the remaining embodiments of this disclosure as well.

In any case, the axially oriented inlet and delivery fluid commutation ports 68*a* and 68*b* can be formed according to dimensions provided by the gerotor set manufacturer. For instance, such dimensions are tabulated for a wide range of gerotor sets in FIG. 4 of a catalog entitled "Gerotor Selection and Pump Design" available. from Nichols Portland (hereinafter "the Nichols Portland catalog").

The outer rotor 18 is of course urged laterally toward the guide shoulders 30*a* by a force derived from the pressure difference between the fluid pressures present at the axially oriented inlet and delivery fluid commutation ports 68*a* and 68*b*. In gerotor pump 10 that force is impressed upon the floating ring 22 via a hydrodynamic bearing formed in the space 78 between the outer rotor 18 and the floating ring 22. That force is then impressed upon the housing 34 via the guide shoulders 30*a* by the guide flats 28*a* and is then imposed upon the drive motor 48 structure via mounting bolts (not shown). This is balanced by an equal and oppositely directed force imposed upon the drive motor 48 structure via the drive shaft 46 and its shaft bearings 72.

Additionally however, in the gerotor pump 10 the floating ring 22 is urged orthogonally toward an in-mesh position 92 of the gerotor set 12 via pressure applied to a piston 74. The piston 74 is mounted in a cylinder bore 76 formed in the housing 34 and bears against a flat surface 80 formed on the floating ring 22. Sufficient clearance is provided between the piston 74 and the cylinder bore 76 to avoid mechanical over constraint otherwise resulting from the piston's engagement with the flat surface 80. Necessary sealing for the piston 74 is provided by an O-ring 82.

The pressure applied to the piston 74 is the fluid pressure in the delivery port 70*b*. The delivery pressure is conveyed from the delivery port 70*b* to the cylinder bore 76 via a cylinder port 84. Concomitantly, the various cavities surrounding the floating ring 22 and drive shaft 46 are vented to the lower valued fluid pressure in the inlet port 70*a* in a known manner via vent slot 86.

Figure 3:
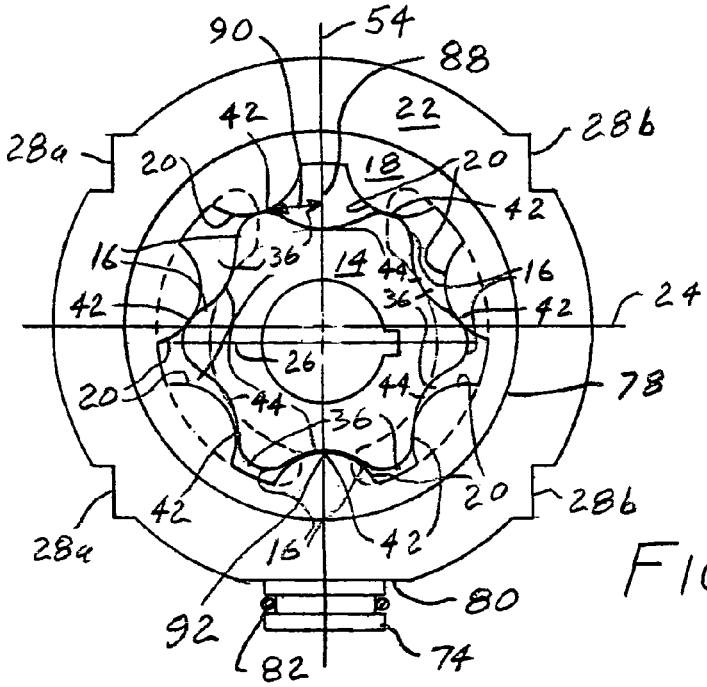
FIG. 3 is a plan view depicting a gerotor set, floating ring and piston utilized in the improved gerotor pump shown in FIG. 2.

In order for the piston 74 to provide sufficient force to effect full time engagement of the outer rotor 18 with the inner rotor 14 at the in-mesh position 92, its area must exceed that of half the maximum area between instant line seal 42 positions at the out-of-mesh position 88 as indicated by numerical indicator 90 in FIG. 3. As a practical matter this suggests that relatively wide gerotor sets 12 should be utilized in the gerotor pump 10. This is because piston area is a square law function of its diameter while the minimum required area is a linear function of gerotor set width. For instance, a gerotor set 12 having an inner rotor 14 with six outwardly extending lobes 16 should have a minimum width equal to perhaps ⅓ of the outer diameter of the outer rotor 18.

In any case, this supplemental orthogonal loading of the floating ring 22 results in a supplemental orthogonal loading of the outer rotor 18 along the eccentricity axis 54 via naturally occurring rotational adjustments within the hydrodynamic bearing formed in the space 78. Thus, an orthogonally directed force proportional to the greater of the input and delivery pressures is applied to the in-mesh end of the outer rotor 18 at a location juxtaposed to the in-mesh position 92 of the gerotor set 12. The end result is that one of the grooves 44 and an inwardly extending lobe 20 are held tightly in mesh at the in-mesh position 92 whereat there is little relative motion between them. This results in substantially friction- and wear-free contact between the grooves 44 and the inwardly extending lobes 20 and sharply reduced forceful contact, and therefore minimized wear, between the outwardly extending lobes 16 and the inwardly extending lobes 20.

Figure 4:
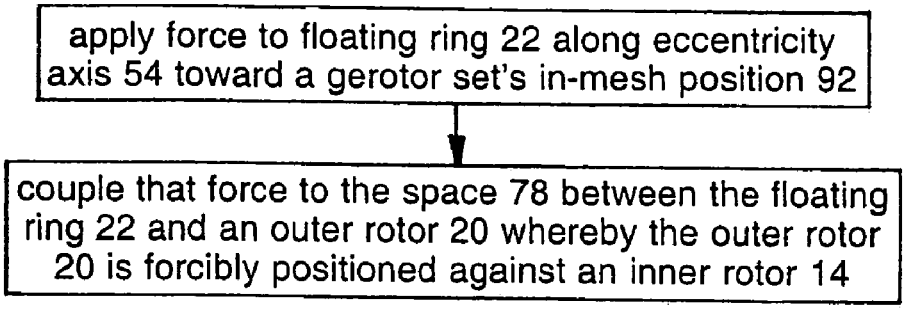
FIG. 4 is a flow chart depicting an improved method for supporting a gerotor set comprised in a gerotor pump.

Thus, an improved method for supporting a gerotor set 12 positioned in a laterally located floating ring 22 in a gerotor pump such as gerotor pump 10 has been enabled by the preferred embodiment of the present invention. As depicted in FIG. 4, this method minimally comprises the steps of: applying force to floating ring 22 along the eccentricity axis 54 toward a gerotor set's in-mesh position 92; and coupling that force to the space 78 between the floating ring 22 and an outer rotor 18 whereby the outer rotor 18 is forcibly positioned against an inner rotor 14.

Figure 5:
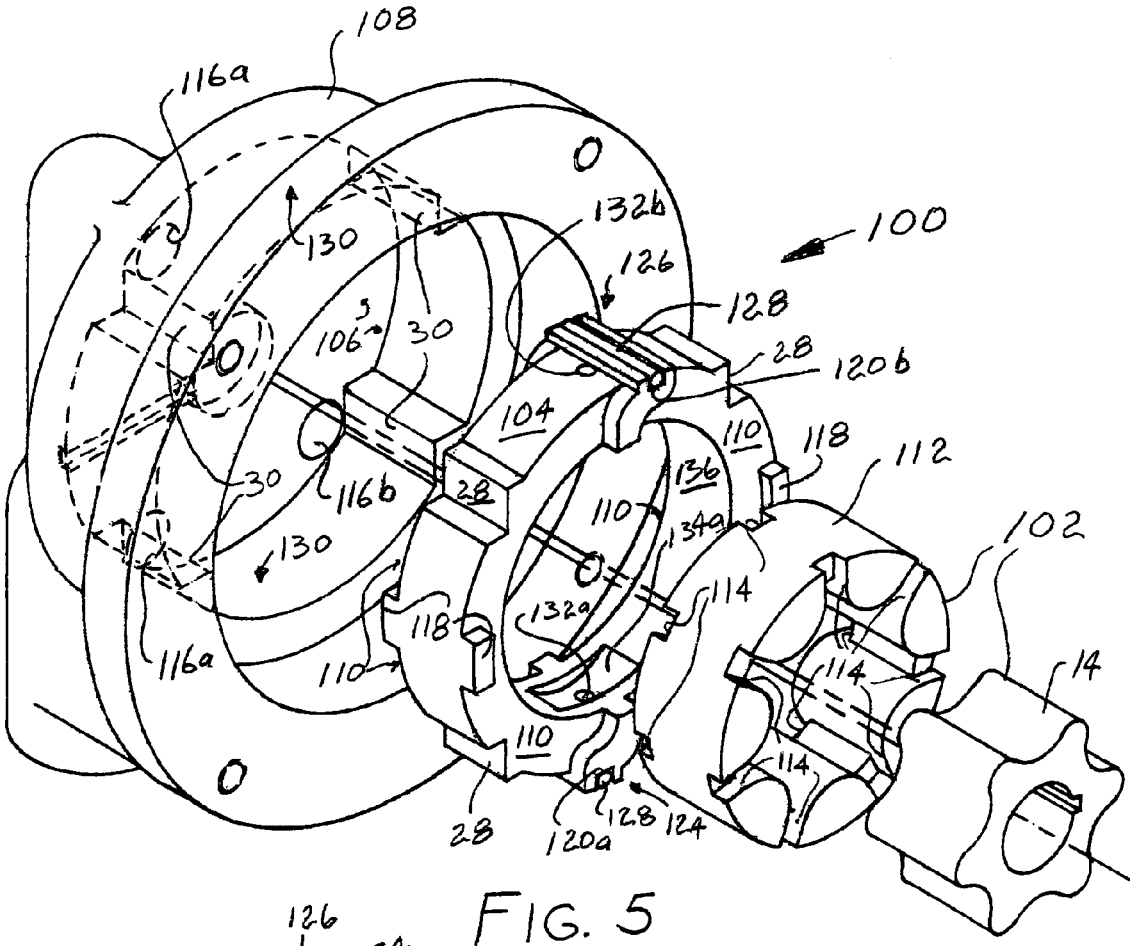
FIG. 5 is an exploded isometric view of operative elements of another improved gerotor pump according to a first alternate preferred embodiment of the present invention.
Figure 6:
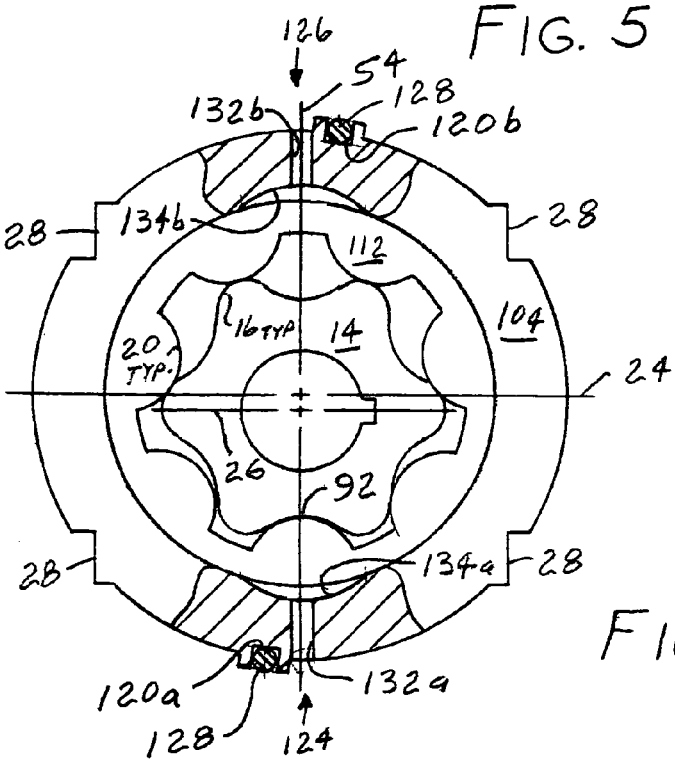
FIG. 6 is a plan view depicting first and second pins utilized as check valves and pockets utilized for applying orthogonally directed hydrostatic pressure to an outer rotor of the improved gerotor pump shown in FIG. 5.

With reference now to FIGS. 5 and 6, thereshown in exploded isometric and plan views is an improved unidirectional gerotor pump 100 according to a first alternate preferred embodiment of the present invention. In this case, a gerotor set 102 is inserted in a floating ring 104 that is again located laterally via first and second sets of orthogonally directed guide flats 28 formed thereon slidingly engaging first and second sets of orthogonally directed guide shoulders 30 formed as part of a gerotor pocket 106 in a housing 108. This time however, the floating ring 104 has face fluid commutation ports 110 formed in either side. The face fluid commutation ports 110 interdict radial face slots 114 formed on either side of an outer rotor 112. In order to effect proper commutation, spacing between ends of the face fluid commutation ports 110 is equal to the width of the radial face slots 114. Fluid communication between the face fluid commutation ports 110 and respective inlet and delivery ports 116*a* and 116*b* is generally provided by unrestricted fluid flow through the gerotor pocket 106. Multiple inlet ports 116*a* are utilized to provide reduced inlet fluid pressure loss and thereby reduce the likelihood of cavitation. In addition, bosses 118 are formed on both sides of the lateral portions of the floating ring 104 in order to provide it with yaw stability.

First and second slots 120*a* and 120*b* are respectively formed on the in-mesh and out-of-mesh ends 124 and 126 of the floating ring 104. The first and second slots 120*a* and 120*b* are equidistantly positioned from the eccentricity axis 54 with the first slot 120*a* positioned toward the inlet side of the gerotor pocket 106 and the second slot 120*b* positioned toward the delivery side of the gerotor pocket 106. Sealing between the delivery and inlet sides of the gerotor pocket 106 is accomplished via pins 128 freely moving within the first and second slots 120*a* and 120*b* whereby they act as check valves in sealing the nominal clearance space between the floating ring 104 and juxtaposed surfaces 130 of gerotor pocket 106. The opposite positioning of the first and second slots 120*a* and 120*b* results in an orthogonal force equal in value to the product of projected orthogonal spacing between pins 128, depth of the gerotor pocket 106, and the difference between delivery and inlet pressures.

In addition, first and second holes 132*a* and 132*b* respectively convey delivery and inlet pressure to first and second cavities 134*a* and 134*b* respectively formed symmetrically about the eccentricity axis 54 on the inner surface 136 of the floating ring 104. The first and second cavities 134*a* and 134*b* are configured such that, in combination with individual fluid pressures conveyed to the periphery of the outer rotor 112 by the radial face slots 114, the resulting forces applied to the inner surface 136 of floating ring 104 along the eccentricity axis are in nominal hydrostatic balance with the externally applied orthogonal force. In addition, the radial face slots 114 convey each individual pumping chamber's pressure to juxtaposed edges of the periphery of the outer rotor 112. This provides a distribution of pressure around the outer rotor 112 that tends to balance transverse outer rotor loading in the lateral direction. And of course, the outwardly and inwardly extending lobes 16 and 20 of the inner and outer rotors 14 and 112 are again held tightly in mesh at the in-mesh position 92 whereat there is almost no relative motion between them and only passive contact elsewhere.

Figure 7:
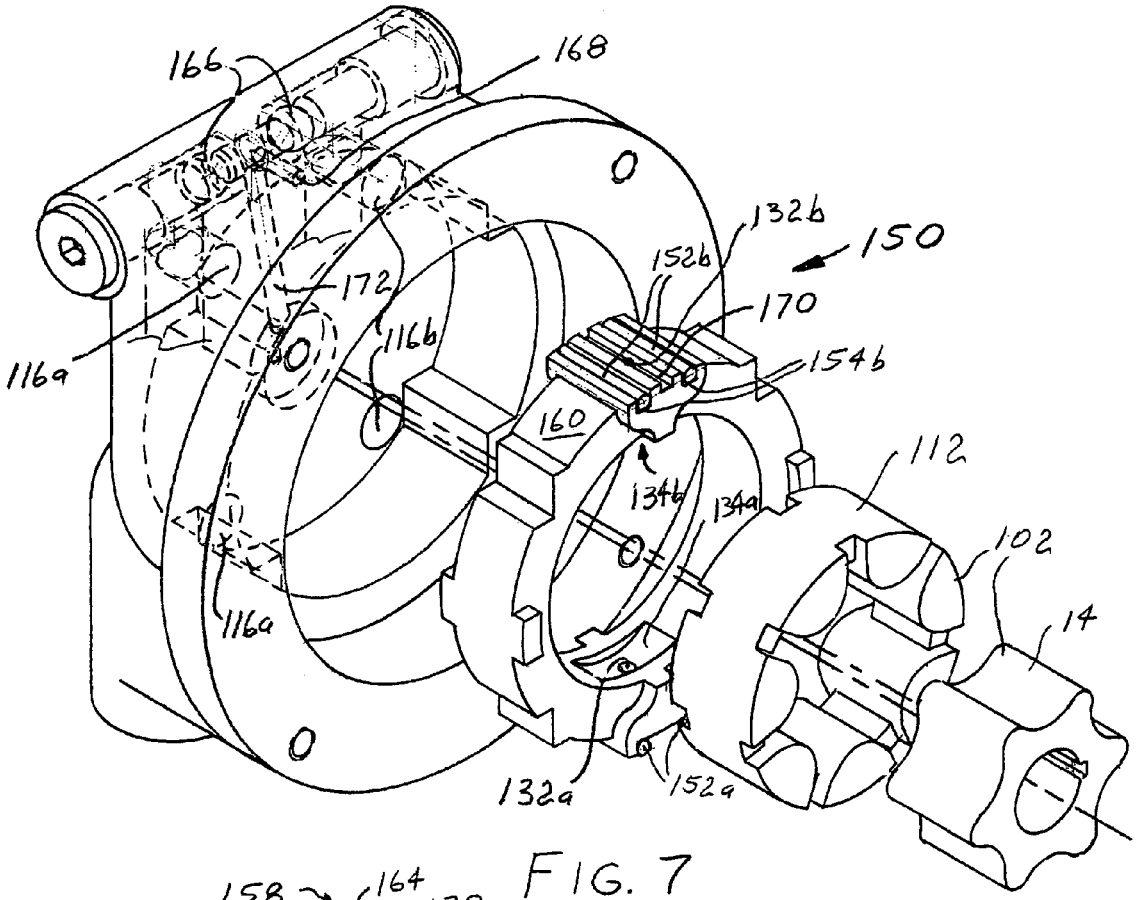
FIG. 7 is an exploded isometric view of operative elements of another improved gerotor pump according to a second alternate preferred embodiment of the present invention.
Figure 8:
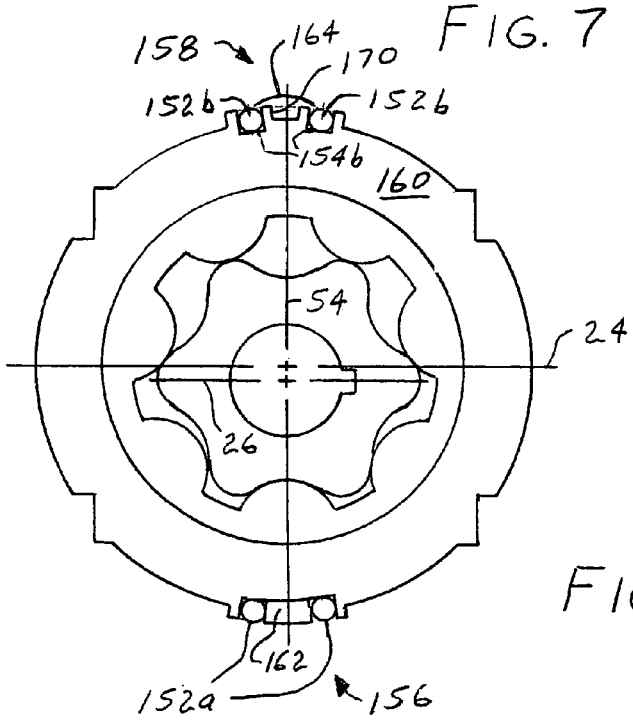
FIG. 8 is a plan view depicting first and second sets of pins utilized as check valves in the improved gerotor pump shown in FIG. 7.

With reference now to FIGS. 7 and 8, thereshown in exploded isometric and plan views is an improved reversible gerotor pump 150 according to a second alternate preferred embodiment of the present invention. In this case, bi-directional operation is provided via insertion of first and second pairs of laterally spaced apart pins 152*a* and 152*b* respectively disposed in first and second pairs of slots 154*a* and 154*b* formed on the in-mesh and out-of-mesh ends 156 and 158 of yet another floating ring 160, respectively. The individual slots 154 of the first and second pairs of slots 154*a* and 154*b* are formed equidistant from the eccentricity axis 54. The slots 154 comprised in the first pair of slots 154*a* are fluidly coupled one-to-another via linking cavities 162 extruded into the faces of the floating ring 160. This results in either of the first pair of pins 152*b* acting as a check valve that provides the space bounded by the linking cavities 162 with fluid having the higher pressure.

On the other hand, the space 164 between the second pair of slots 154*b* is vented to fluid having the lower pressure in a known manner via check valves 166, a first venting port 168 and a venting slot 170. Similarly, the cavities surrounding the drive shaft 46 are also vented to fluid having the lower pressure via a second venting port 172. In this case, the pin 152*b* instantly interfacing with the higher pressure fluid acts as a check valve. Again, first and second holes 132*a* and 132*b*, and cavities 134*a* and 134*b* are formed in the floating ring 160 such that the outer rotor 112 is forcibly positioned against the inner rotor 14 at the in-mesh position 92. Thus, the floating ring 160 is substantially balanced in the orthogonal direction. And of course, the first and second sets of pins 152*a* and 152*b* again act to keep delivery fluid from mixing with the inlet fluid.

Thus, forces otherwise imposed upon the hydrodynamic bearing have been reduced. And, the outwardly and inwardly extending lobes 16 and 20 of the inner and outer rotors 14 and 112 are held tightly in mesh at the in-mesh position 92 whereat there is almost no relative motion between them and only passive contact elsewhere. The resulting lack of rotational friction provides for very smooth operation at low speeds as might very well be required in a reversible pump or hydraulic motor utilized in a servo system.

It is worth noting that in either of improved gerotor pumps 100 or 150, improved performance with viscous fluids and/or at high operational speeds is obtained because the rate at which either of face fluid commutation ports 110 is opened or closed is significantly quicker than with axially oriented fluid commutation ports 68*a* or 68*b* configured as recommended in the Nichols Portland catalog. Thus, an improved method for conveying fluid into and out of pumping chambers of a gerotor pump has been so enabled. As fully described in the incorporated '812 patent application, this method comprises the steps of implementing radial passages in the outer rotor of a gerotor set, implementing fluid commutation ports interdicting only the radial passages, and utilizing movement of the radial passages over the ends of the fluid commutation ports for switching pumping chamber fluid connection from one fluid commutation port to the other.

Figure 9:
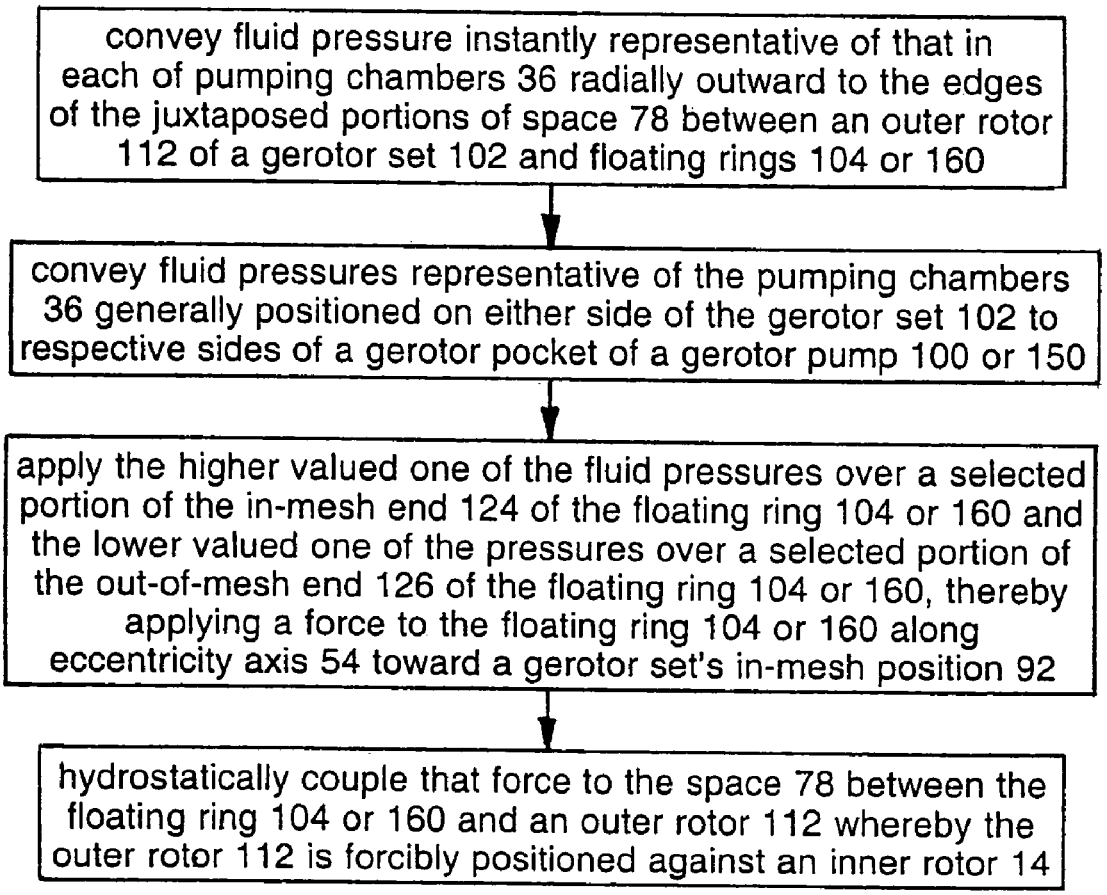
FIG. 9 is another flow chart depicting an alternate improved method for supporting a gerotor set comprised in a gerotor pump.

In any case, an alternate improved method for supporting a gerotor set 102 positioned in a laterally located and roll oriented floating ring such as floating ring 104 or 160 in a gerotor pump configured similarly to gerotor pump 100 or 150 has been enabled by either of the first or second alternate preferred embodiments of the present invention. As depicted in FIG. 9, this method comprises the steps of: conveying fluid pressure instantly representative of that in each of pumping chambers 36 radially outward to the edges of the juxtaposed portions of space 78 between an outer rotor 112 of a gerotor set 102 and floating rings 104 or 160; conveying fluid pressures representative of the pumping chambers 36 generally positioned on either side of the gerotor set 102 to respective sides of a gerotor pocket of a gerotor pump 100 or 150; applying the higher valued one of the fluid pressures over a selected portion of the in-mesh end 124 of the floating ring 104 or 160 and the lower valued one of the pressures over a selected portion of the out-of-mesh end 126 of the floating ring 104 or 160, thereby applying a force to the floating ring 104 or 160 along the eccentricity axis 54 toward the gerotor set's in-mesh position 92; and hydrostatically coupling that force to the space 78 between the floating ring 104 or 160 and an outer rotor 112 whereby the outer rotor 112 is forcibly positioned against an inner rotor 14.

Having described the invention, however, many modifications thereto will become immediately apparent to those skilled in the art to which it pertains, without deviation from the spirit of the invention. For instance, narrowed and elongated cavities 134*a* and 134*b* could be experimented with in order to further reduce the summation of laterally directed forces on the outer rotor 18. And of course, the improvements described herein can be applied to stand-alone pumps with their own drive shafts, shaft seals and shaft bearings. All such modifications fall within the scope of the invention.

INDUSTRIAL APPLICABILITY

The instant gerotor pumps are capable of providing fluid delivery substantially without internal friction and wear for a wide range of applications, and accordingly find industrial application in various industries both in America and abroad.

The invention claimed is:

1. An improved gerotor pump of the type having a gerotor set comprising;

an inner rotor having N outwardly extending lobes with N approximately circularly shaped grooves therebetween being in mesh with and, in response to rotational motion of a drive shaft, rotationally driving an eccentrically disposed outer rotor about an eccentrically offset rotation axis located along a preferred eccentricity axis, the outer rotor being formed with N+1 inwardly extending circularly shaped elements with N+1 approximately circularly shaped grooves therebetween, whereby N+1 pumping chambers are formed between the outwardly extending lobes of the inner rotor, the inwardly extending circularly shaped elements of the outer rotor and the grooves of either, a floating ring having a bore wherein the outer rotor is hydro-dynamically supported for rotation, and a housing having an internal gerotor pump cavity and first and second housing ports located on opposite side of the preferred eccentricity axis, wherein radial face slots are provided in at least one face of the outer rotor for fluidly coupling fluid with the N+1 approximately circularly shaped grooves of the outer rotor respectively with first and second fluid communication ports formed on opposite sides of the floating ring in a corresponding face or faces of the floating ring, further wherein the floating ring having the internal pump cavity have slidingly engaging floating ring and housing guide features for locating the floating ring such that the center of the floating ring bore is laterally located along the preferred eccentricity axis and the floating ring is oriented in the roll direction such that the first and second fluid commutation ports are symmetrically located on either side of the preferred eccentricity axis, and still further wherein the first and second housing ports are located and formed within the housing in such a manner that first and second housing ports respectively fluidly communicate with the first and second fluid communication ports and; means are provided for forcibly positioning the outer rotor along the eccentricity axis against the inner rotor at an in-mesh position of the gerotor set, said means for forcibly positioning the outer rotor along the eccentricity axis against the inner rotor at the gerotor set's in-mesh position comprises means for selectivity coupling fluid from the higher pressure valued one of the first and second housing ports to a selected portion of the outer periphery of the floating ring an a position juxtaposed to the gerotor set's in-mesh position, and concomitantly selectively coupling fluid from the lower pressure valued one of the first and second housing ports to a selected portion of the outer periphery of the floating ring at a position juxtaposed to the gerotor set's out-of-mesh position.

2. An improved gerotor pump of the type having a gerotor set comprising an inner rotor having N outwardly extending lobes with N approximately circularly shaped grooves therebetween being in mesh with and, in response to rotational motion of a drive shaft, rotationally driving an eccentrically disposed outer rotor about an eccentricity offset rotation axis located along a preferred eccentricity axis, the outer rotor being formed with N+1 inwardly extending circularly shaped elements with N+1 approximately circularly shaped grooves therebetween, whereby N+1 pumping chambers are formed between the outwardly extending lobes of the inner rotor, the inwardly extending circularly shaped elements of the outer rotor and the grooves of either, a floating ring having a bore wherein the outer rotor is hydro-dynamically supported for rotation, and a housing having an internal gerotor pump cavity and first and second housing ports located on opposite sides of the preferred eccentricity axis, wherein radial face slots are provided in at least one face of the outer rotor for fluidly coupling fluid with the N+1 approximately circularly shaped groves of the outer rotor respectively with first and second fluid communication ports formed on opposite sides of the floating ring in a corresponding face or faces of the floating ring, further wherein the floating ring and the internal pumping cavity have a slidingly engaging floating ring and housing guided features for locating the floating ring such that the center of the floating ring bore is laterally located along the preferred eccentricity axis and the floating ring is oriented in the roll direction such that the first and second fluid commutation ports are symmetrically located on either side of the preferred eccentricity axis, still further wherein the first and second housing ports are located and formed within the housing in such a manner that the first and second housing ports respectively fluidly communicate with the first and second fluid commutation ports, and yet still further wherein a piston means bearing against the floating ring at a position juxtaposed to the gerotor set's in-mesh position is utilized for forcibly positioning the outer rotor along the eccentricity axis against the inner rotor at an in-mesh position of the gerotor set.

3. An improved method for supporting a gerotor set in a gerotor pump comprising a housing having an internal gerotor pump cavity and first and second housing ports located on opposite side of the preferred eccentricity axis, a gerotor set comprising inner and outer rotor, and a floating ring having a bore wherein the outer rotor is hydro-dynamically supported for rotation, the floating ring being postionally constrained for lateral location along the preferred eccentricity axis at a selected roll orientation, wherein the method comprises the steps of;

selectively coupling fluid from the higher pressure valued one of the first and second housing ports to a selected portion of the outer periphery of the floating ring at a position juxtaposed to an in-mesh position of the gerotor set;

concomitantly selectively coupling fluid from the lower pressure valued one of the first and second housing ports to a selected portion of the outer periphery of the floating ring at a position juxtaposed to the in-mesh position of the gerotor set; and hydrostatically coupling those pressure values to selected portions of a space between the floating ring and the outer rotor, whereby the outer rotor is forcibly positioned against the inner rotor at the in-mesh position of the gerotor set.

* * * * *